US007398768B2

(12) United States Patent
Usui et al.

(10) Patent No.: US 7,398,768 B2
(45) Date of Patent: Jul. 15, 2008

(54) ELECTROMAGNETIC DRIVE MECHANISM AND A HIGH-PRESSURE FUEL SUPPLY PUMP

(75) Inventors: Satoshi Usui, Tokyo (JP); Kenichiro Tokuo, Tokyo (JP); Hiroyuki Yamada, Tokyo (JP); Masami Abe, Ibaraki (JP); Hiroshi Odakura, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/354,851

(22) Filed: Feb. 16, 2006

(65) Prior Publication Data

US 2006/0201485 A1 Sep. 14, 2006

(30) Foreign Application Priority Data

Mar. 11, 2005 (JP) ..... 2005-069668

(51) Int. Cl.
*F02M 37/04* (2006.01)

(52) U.S. Cl. ..... 123/506; 123/446

(58) Field of Classification Search ..... 123/458, 123/446, 456, 506, 500, 501; 251/129.02, 251/129.07, 129.03; 137/614.2, 614.19
See application file for complete search history.

(56) References Cited

U.S. PATENT DOCUMENTS 4,475,513 A * 10/1984 Flaig et al. ..... 123/446
4,546,749 A * 10/1985 Igashira et al. ..... 123/506
4,586,480 A * 5/1986 Kobayashi et al. ..... 123/506
5,230,613 A * 7/1993 Hilsbos et al. ..... 417/439
5,878,965 A * 3/1999 Coldren et al. ..... 239/585.1
6,065,436 A * 5/2000 Koga et al. ..... 123/179.17
6,318,343 B1 * 11/2001 Nakagawa et al. ..... 123/500
6,447,273 B1 * 9/2002 Nishimura et al. ..... 417/505
6,640,788 B2 * 11/2003 Inoue et al. ..... 123/506
7,124,738 B2 * 10/2006 Usui et al. ..... 123/446
2004/0000289 A1 * 1/2004 Seo et al. ..... 123/447
2005/0126539 A1 * 6/2005 Okamoto ..... 123/446

FOREIGN PATENT DOCUMENTS

EP 0 840 009 A 5/1998
EP 1 296 061 A 3/2003
EP 1 471 248 A 10/2004
EP 1 013 922 A 1/2006
JP 2002-250462 9/2002
WO WO 00/06894 A 2/2000

OTHER PUBLICATIONS

European Search Report dated Aug. 1, 2006.

* cited by examiner

*Primary Examiner*—Carl S. Miller
(74) *Attorney, Agent, or Firm*—Crowell & Moring LLP

(57) ABSTRACT

The objective of the present invention is to dampen operating sounds of an electromagnetic drive mechanism used for a variable displacement control mechanism in a high-pressure fuel supply pump to reduce an individual difference depending on apparatus due to the change over time or installation tolerance.

To achieve the above objective, the present invention is configured such that before the electromagnetic drive mechanism supplies a drive force to a plunger which is electromagnetically driven by the electromagnetic drive mechanism, another displacement force situates the plunger in a specific position. When compared to an occasion where the plunger is displaced all strokes by a magnetic biasing force, the above configuration is able to reduce the force of impact on a member (for example, valve body) mounted to the plunger and a restricting member, thereby damping the collision noise. Furthermore, since an extra member, such as a damping member, is not required, individual difference depending on apparatus do not easily occur.

17 Claims, 12 Drawing Sheets

ELECTROMAGNETIC DRIVE MECHANISM AND A HIGH-PRESSURE FUEL SUPPLY PUMP

CLAIM OF PRIORITY

The present application claims priority from Japanese application Ser. No. 2005-069668, filed on Mar. 11, 2005, the contents of which is hereby incorporated by references into this application.

BACKGROUND OF THE INVENTION

1. Field of the Invention

The present invention relates to an electromagnetic drive mechanism, and specifically to a high-pressure fuel supply pump for an internal combustion engine that uses this kind of electromagnetic drive mechanism.

2. Description of Related Art

In a high-pressure fuel supply pump comprising a fuel discharge variable controlling mechanism that includes an electromagnetic drive mechanism described in Japanese Application Patent Laid-Open Publication No. 2002-250462, a damping alloy is provided in a restriction part for restricting the movement of a movable member in order to dampen operating sounds of a variable displacement control mechanism including an electromagnetic drive mechanism.

[Patent Document 1] Japanese Application Patent Laid-Open Publication No. 2002-250462

SUMMARY OF THE INVENTION

However, this configuration will increase cost and may create an individual difference depending on apparatus (difference of control characteristics among individual electromagnetic drive mechanisms) due to change over time or installation tolerance of a damping member.

The object of the-present invention is to reduce an individual difference depending on apparatus due to the change over time or installation tolerance when damping operating sounds of an electromagnetic drive mechanism used for a variable displacement control mechanism in a high-pressure fuel supply pump.

To achieve the above object, the present invention is configured such that before the electromagnetic drive mechanism supplies a drive force to a plunger which is electromagnetically driven by the electromagnetic drive mechanism, another displacement force situates the plunger in a specific position.

When compared to an occasion where the plunger is displaced all strokes by a magnetic biasing force, the above configuration is able to reduce the force of impact on a member (for example, valve body) mounted to the plunger and a restricting member, thereby damping the collision noise.

Furthermore, since an extra member, such as a damping member, is not required, an individual difference depending on apparatus is not easily occured.

DETAILED DESCRIPTION OF THE INVENTION

Hereafter, embodiments of the present invention will be explained with reference to the drawings.

Embodiment 1

Figure 1:
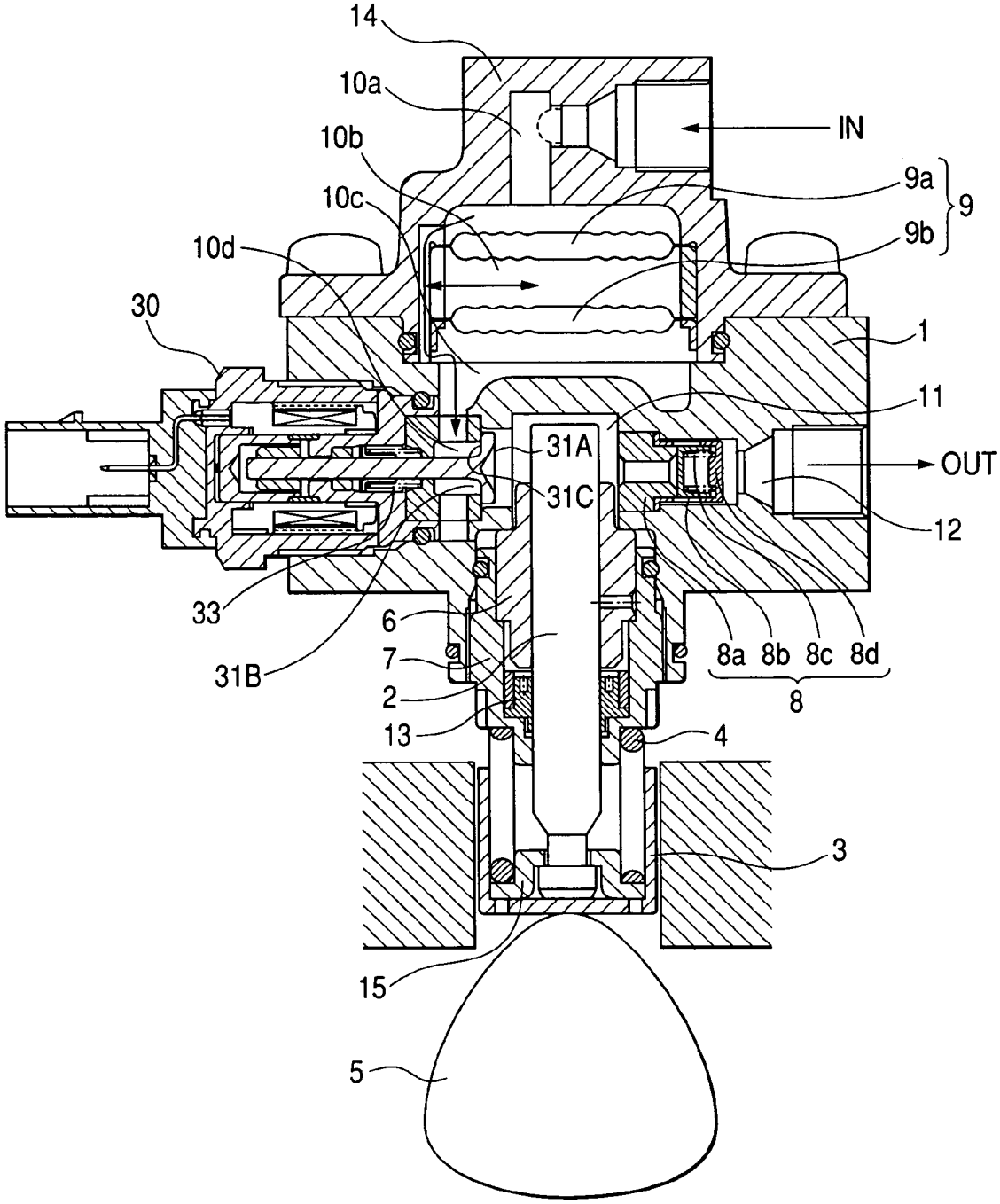
FIG. 1 is a longitudinal sectional view of a high-pressure fuel supply pump of a first embodiment according to the present invention.

FIG. 1 is a longitudinal sectional view of an entire high-pressure fuel supply pump of a first embodiment according to the present invention.

Figure 2:
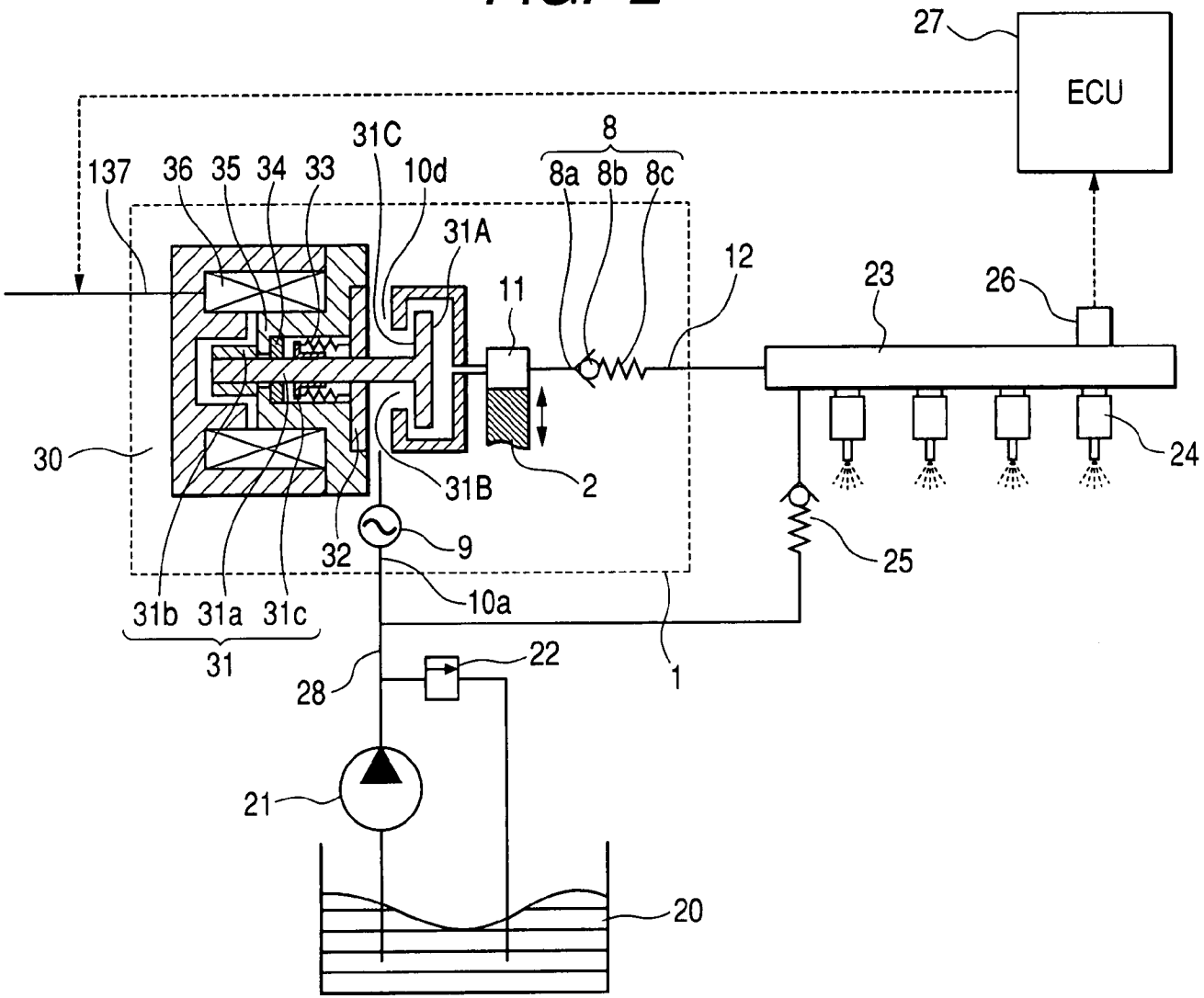
FIG. 2 is a fuel supply system as an example, that uses a high-pressure fuel supply pump according to the present invention.

FIG. 2 is a schematic system diagram of a fuel supply system of an internal combustion engine.

A damper cover 14 including a pressure pulsation damping mechanism 9 for damping the fuel pressure pulsation is mounted to the pump body 1. The damper cover 14 has a fuel intake port 10*a*.

An intake passage 10 comprises fuel intake ports 10*a*, 10*b*, 10*c* and 10*d*, and a pressure pulsation damping mechanism 9 for damping the fuel pressure pulsation is located in the middle of the passage.

A fuel discharge port 12 is provided in the pump body 1, and a pressure chamber 11 for pressurizing fuel is provided in the middle of the fuel passage which extends from the fuel intake port 10*a*to the fuel discharge port 12.

An electromagnetic intake valve 30 is provided at the inlet of the pressure chamber 11. The electromagnetic intake valve 30 receives a biasing force in the direction that closes the intake port by an intake valve spring 33 provided in the electromagnetic intake valve 30. This configuration enables the electromagnetic intake valve 30 to function as a check valve which controls the direction of the fuel flow.

A discharge valve 8 is provided at the outlet of the pressure chamber 11. The discharge valve 8 comprises a discharge valve seat 8*a*, discharge valve 8*b*, discharge valve spring 8*c*, and a discharge valve stopper 8*d*. When there is no fuel differential pressure between the pressure chamber 11 and the fuel discharge port 12, the discharge valve 8*b* is contact-bonded onto the discharge valve seat 8*a* by means of a biasing force caused by the discharge valve spring 8*c*, thereby the valve is closed. When the fuel pressure of the pressure chamber 11 becomes larger than that of the fuel discharge port 12, the discharge valve 8*b* begins to resist the discharge valve spring 8*c*, thereby opening the valve; then, fuel in the pressure chamber 11 is delivered under high pressure to a common rail 23 via the fuel discharge port 12. When the discharge valve 8*b* opens, it comes in contact with the discharge valve stopper 8*d*, resulting in the restriction of the valve operation. Therefore, the stroke of the discharge valve 8*b* is properly determined by the discharge valve stopper 8*d*. If the stroke is too long, fuel delivered to the fuel discharge port 12 under high pressure will flow back into the pressure chamber 11 due to the delay of closing the discharge valve 8*b*, thereby decreasing the efficiency of a high-pressure pump. Furthermore, when the discharge valve 8*b* repeatedly opens and closes, the discharge valve stopper 8*d* directs so that the discharge valve 8*b* moves only in the direction of the stroke. This configuration enables the discharge valve 8 to function as a check valve which controls the direction of the fuel flow.

The outer circumference of a cylinder 6 is held by a cylinder holder 7, and the cylinder 6 is mounted to the pump body 1 by inserting a screw which is threaded on the outer circumference of the cylinder holder 7 into a screw thread made on the pump body. The cylinder 6 holds a plunger 2, which is a pressurizing member, so that the plunger 2 can vertically slide.

A tappet 3, which converts a rotating motion of the cam 5 into a vertical motion and conveys that motion to the plunger 2, is provided at the lower end of the plunger 2. The plunger 2 is contact-bonded onto the tappet 3 by a spring 4 via a retainer 15. This configuration can move the plunger 2 up and down according to the rotation of the cam 5.

Furthermore, as shown in the drawing, the lower end of the cylinder 6 is sealed by a plunger seal 13 in order to prevent gasoline (fuel) from leaking outside. Simultaneously, it prevents lubrication oil (engine oil can be used) which lubricates the sliding part from flowing into the inside of the pump body 1.

A pressure chamber 11 comprises an electromagnetic intake valve 30, fuel discharge valve 12, plunger 2, cylinder 6, and the pump body 1.

Fuel is directed from a fuel tank 20 to the fuel intake port 10*a* of the pump by a low-pressure pump 21 via an intake pipe 28. At that time, the pressure of intake fuel flowing into the pump body 1 is regulated at a constant pressure by a pressure regulator 22. Fuel that has been directed to the fuel intake port 10*a* is pressurized at a high pressure by the pump body 1, and then pressure-fed from a fuel discharge port 12 to a common rail 23. The common rail 23 is equipped with an injector 24, relief valve 25, and a pressure sensor 26. Injectors 24 are mounted in accordance with the number of cylinders of the internal combustion engine, and inject fuel according to a signal from the engine control unit (ECU) 27. Furthermore, the relief valve 25 opens when the pressure inside the common rail 23 exceeds a certain level, thereby preventing the pipe from being damaged.

Next, by referring to FIGS. 3, 4, and 5, a variable displacement control mechanism which controls the amount of fuel delivered under high pressure will be described.

Figure 3:
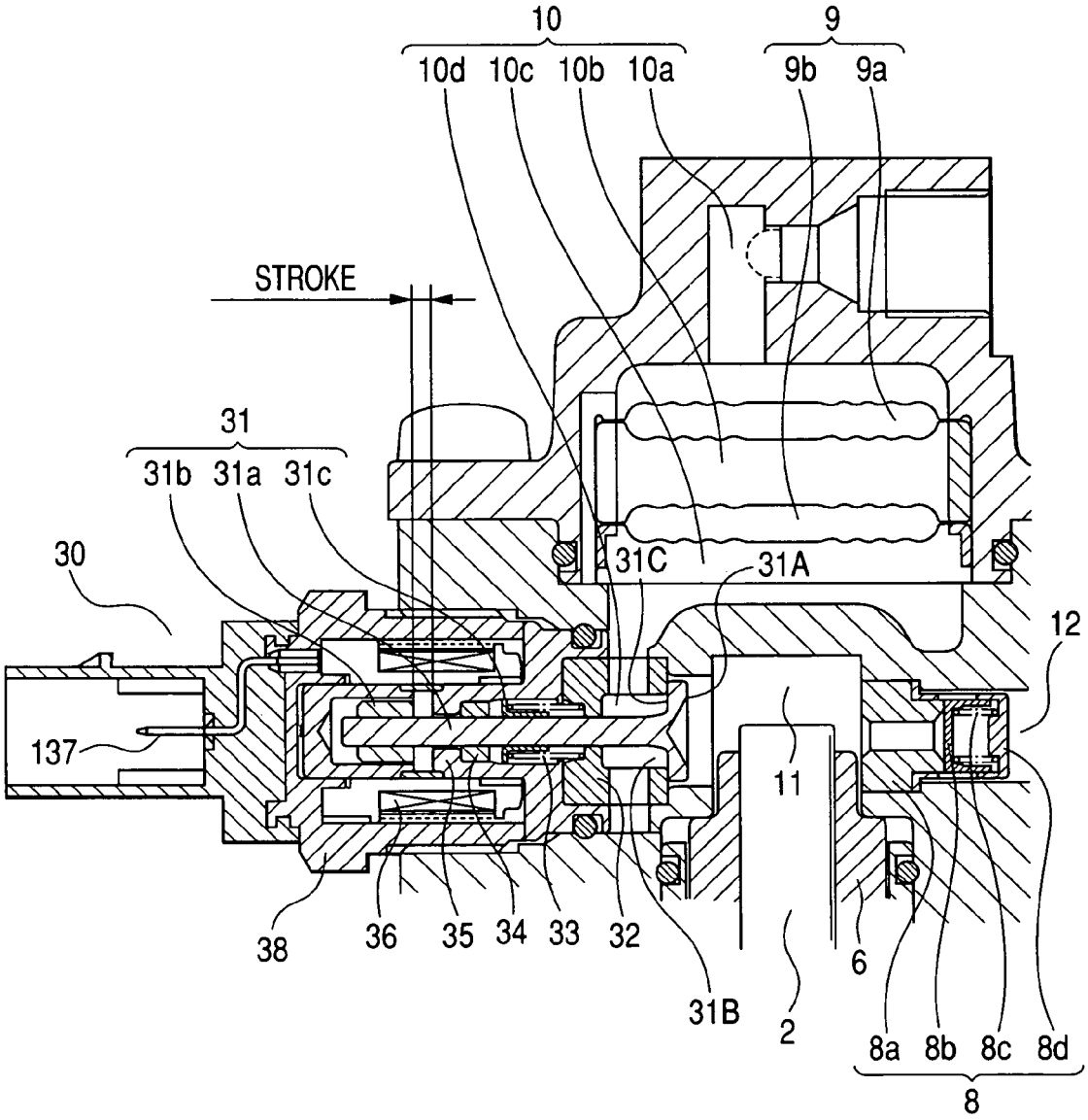
FIG. 3 is a partial longitudinal sectional view of a high-pressure fuel supply pump at an electromagnetic intake valve is closed in a first embodiment according to the present invention.

FIG. 3 is an enlarged view of the inside of the pump when an electromagnetic intake valve 30 is closed.

Figure 4:
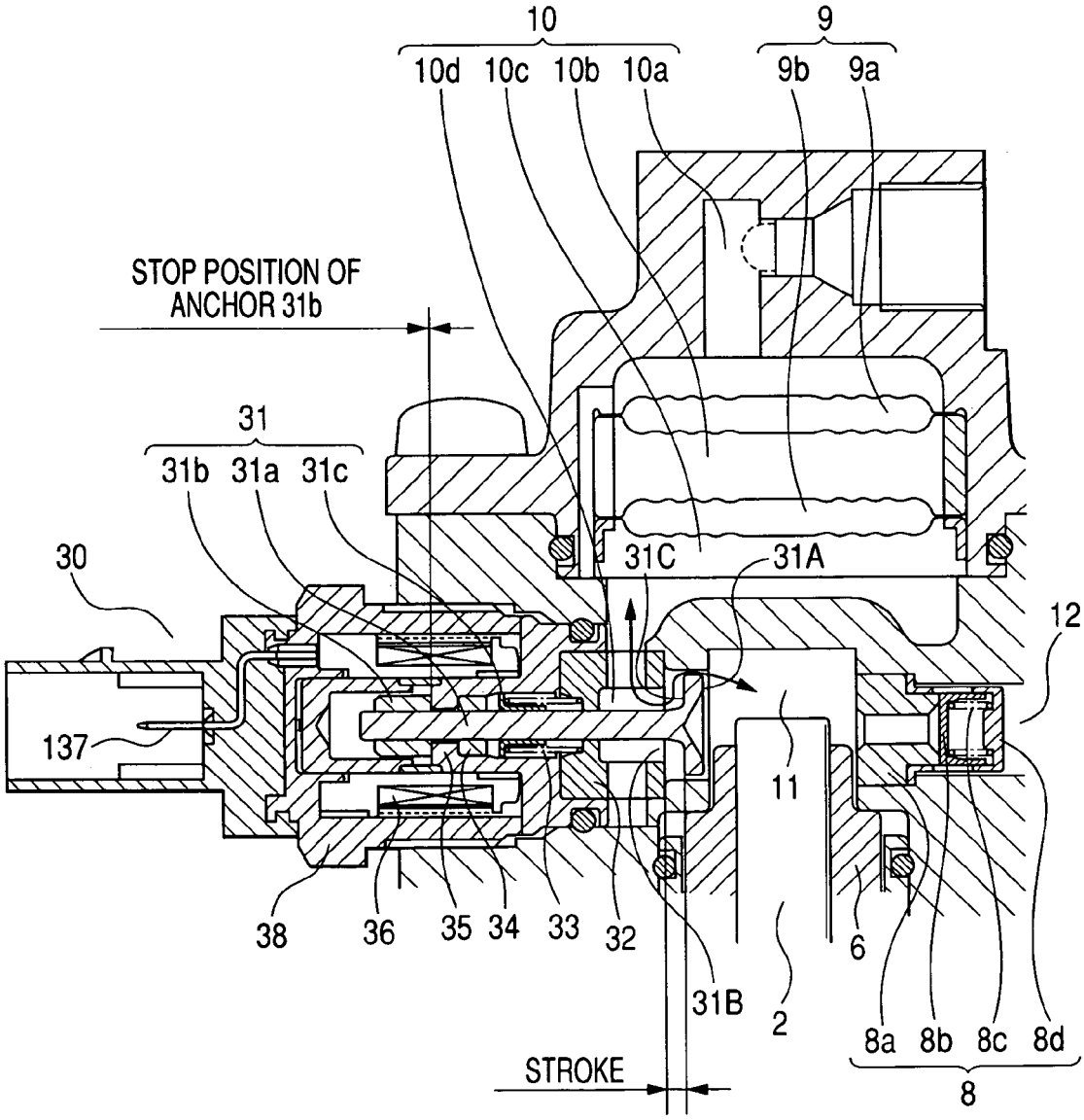
FIG. 4 is a partial longitudinal sectional view of a high-pressure fuel supply pump at an electromagnetic intake valve is opened in a first embodiment according to the present invention.

FIG. 4 is an enlarged view of the inside of the pump. What is different from FIG. 3 is that an electrical intake valve 30 is open in FIG. 4.

Figure 5:
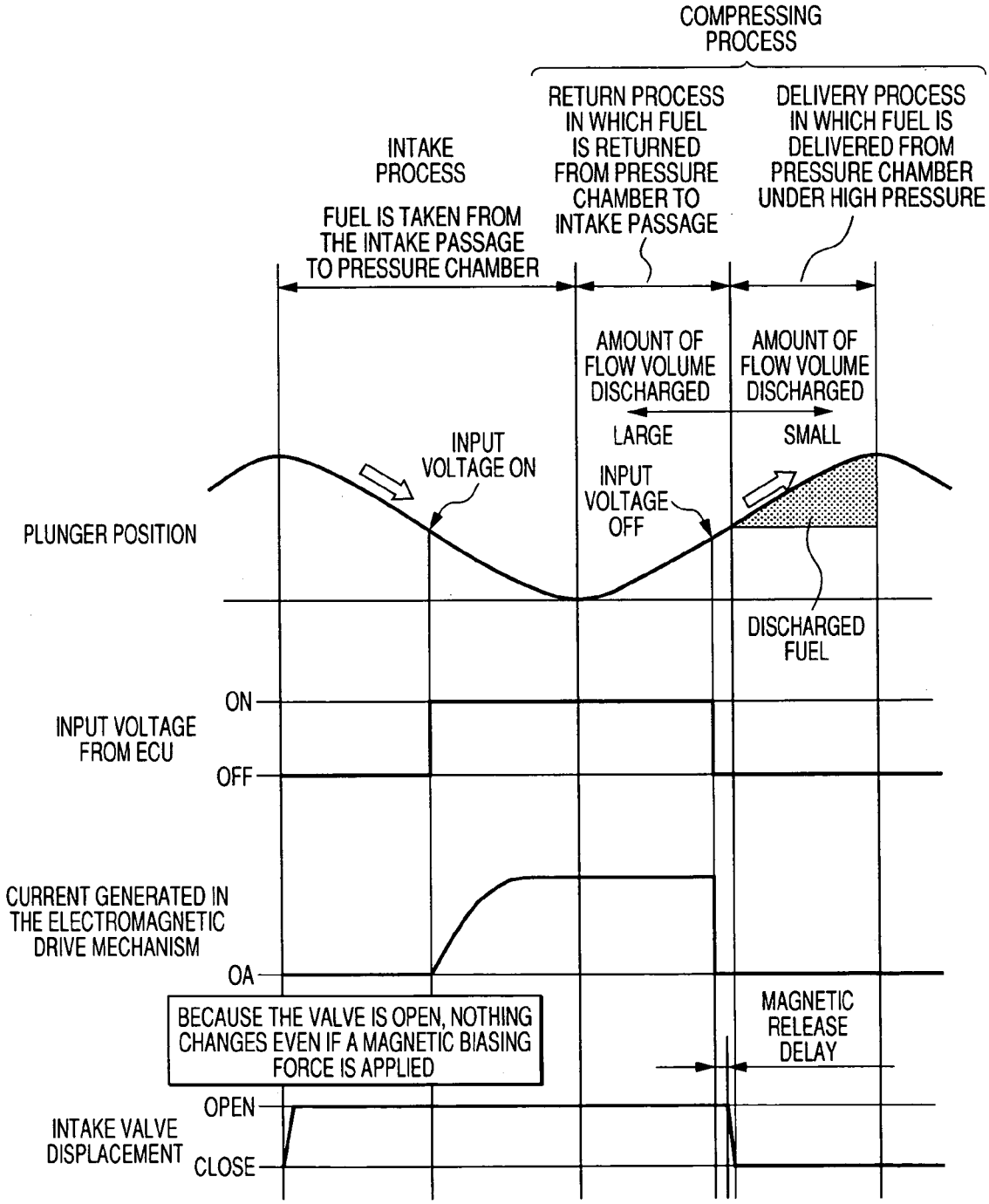
FIG. 5 is an operation diagram of a high-pressure fuel supply pump of a first embodiment according to the present invention.

FIG. 5 shows an operation diagram of a high-pressure fuel supply pump of the embodiment according to the present invention.

The intake valve 31 comprises an intake valve plunger 31*a* which has an intake valve 31A on the tip, an anchor 31*b*, and a spring stopper 31*c*. The anchor 31*b* and the spring stopper 31*c* are press-fitted to the intake valve plunger 31*a*. When the intake valve 31A is closed, the seat 31C blocks the intake port 31B, thereby blocking the intake passage 10 and the pressure chamber 11.

The intake valve spring 33 determines a biasing force in a position at which the spring stopper 31*c* press-fits.

When an input voltage applied to an electromagnetic drive mechanism is shut off and there is no magnetic biasing force, and also when there is no fluid differential pressure between the intake passage 10*d* and the pressure chamber 11, the biasing force of the intake valve spring 33 biases the intake valve 31 in the direction of closing the valve, as shown in FIG. 3, thereby closing the valve.

When the plunger 2 is functioning in the intake process as the result of the rotation of the cam 5, the volume of the pressure chamber 11 increases and the fuel pressure decreases. If the fuel pressure of the pressure chamber 11 becomes lower than the pressure of the intake passage 10*d*, a valve-opening force is generated by fluid differential pressure of fuel in the intake valve 31.

Due to the valve-opening force caused by the fluid differential pressure, the intake valve 31 overcomes the biasing force of the intake valve spring 33 thereby becoming fully open as shown in FIG. 4. Since the amount of displacement of the intake valve 31 is restricted by core 35, when the valve is fully open, the anchor 31*b* comes in contact with core 35. Furthermore, the core 35 determines the stroke of the intake valve 31.

In this condition, if an input voltage from the ECU 27 is applied to a coil 36 via a terminal 137, a current flows through the coil 36. The waveform of the flowing current is determined by the resistance value and the inductance value of the coil 36. This current generates a magnetic biasing force that attracts the anchor 31*b* and core 35 to each other. However, since the intake valve 31 has been fully open due to the fluid differential pressure and is coming in contact with core 35, even if a magnetic biasing force is generated at this point, the anchor 31*b* and core 35 will not collide with each other.

Furthermore, since the valve-opening force generated by the fluid differential pressure is much smaller than the magnetic biasing force, slight collision noise is made when the intake valve 31 opens due to the fluid differential pressure and collides with core 35 which is a restricting member.

The above configuration makes it possible to dampen the collision noise made when an electromagnetic intake valve 30 operates without using a damping alloy.

While an input voltage is being ON to the coil 36, the plunger 2 finishes the intake process and moves onto the compressing process.

When the plunger 2 begins the compressing process, the intake valve 31 is still open because there is no valve-opening force due to the fluid differential pressure and the input voltage is still being ON which means that the magnetic biasing force is being applied.

The volume of the pressure chamber 11 reduces according to the compressing movement of the plunger 2; however in this condition, fuel that has been taken into the pressure chamber 11 is returned to the intake passage 10*d* via the intake valve 31 that is open, and therefore, the pressure of the pressure chamber does not increase. This process is called the "return process". At this time, both a biasing force due to an intake valve spring 33 and a valve-closing force due to a fluid force generated when fuel flows back from the pressure chamber 11 to the intake passage 10*d* are applied to the intake valve 31.

However, a very weak biasing force created by the intake valve spring 33 is set.

Thus, sufficient magnetic biasing force can be ensured to keep the valve open.

Also at this time, pressure pulsation is generated in the intake passage 10 due to fuel that has been returned to the intake passage 10*d*. The pressure pulsation is absorbed and dampened by a pressure damping mechanism 9 comprising two pressure pulsation dampers 9*a* and 9*b*; and the transmission of the pressure pulsation being applied to the intake pipe 28 extending from the low-pressure pump 21 to the pump body 1 is eliminated, thereby preventing the intake pipe 28 from being damaged and simultaneously enabling fuel to be supplied to the pressure chamber 11 under stable fuel pressure.

In this condition, if the input voltage from the ECU 27 is shut off, the amount of current that flows through the coil 36 becomes zero; however, the magnetic biasing force applied to the intake valve will be eliminated after a certain time after the input voltage has been turned off (hereafter, this time is referred to as "magnetic release delays"). Because both a biasing force caused by the intake valve spring 33 and a valve-closing force generated when fuel flows back from the pressure chamber 11 to the intake passage 10*d* are applied to the intake valve 31, the valve closes, and at that point in time, the fuel pressure of the pressure chamber 11 increases as the plunger 2 moves upward. Then, the pressure exceeds the pressure of the discharge port 12, fuel that remains in the pressure chamber 11 is delivered under high pressure via a discharge valve 8, and supplied to the common rail 23. This process is called the "delivery process". That is, the plunger's compressing process includes a return process and a delivery process.

Furthermore, it is possible to control the amount of fuel that is delivered under high pressure by controlling the timing at which the application of an input voltage to the coil 36 is OFF. If the input voltage is turned off earlier, the ratio of the return process to the entire compressing process is small and the ratio of the delivery process is large. That is, the amount of fuel that is returned to the intake passage 10*d* is small, and the amount of fuel that is delivered under high pressure is large. On the other hand, if the input voltage is turned off later, the ratio of the return process to the entire compressing process is large and the ratio of the delivery process is small. That is, the amount of fuel that is returned to the intake passage 10*d* is large, and the amount of fuel that is delivered under high pressure is small.

The timing at which the input voltage is turned off is decided by the command of the ECU.

The above configuration ensures a sufficient magnetic biasing force to keep the intake valve 31 open. And also, by controlling the timing for turning off the input voltage, it is possible to control the amount of fuel which is to be delivered under high pressure so that the required amount of fuel to the internal combustion engine can be ensured.

Next, the configuration of an electromagnetic intake valve 30 applied to a high-pressure fuel supply pump will be described with reference to FIG. 6.

Figure 6:
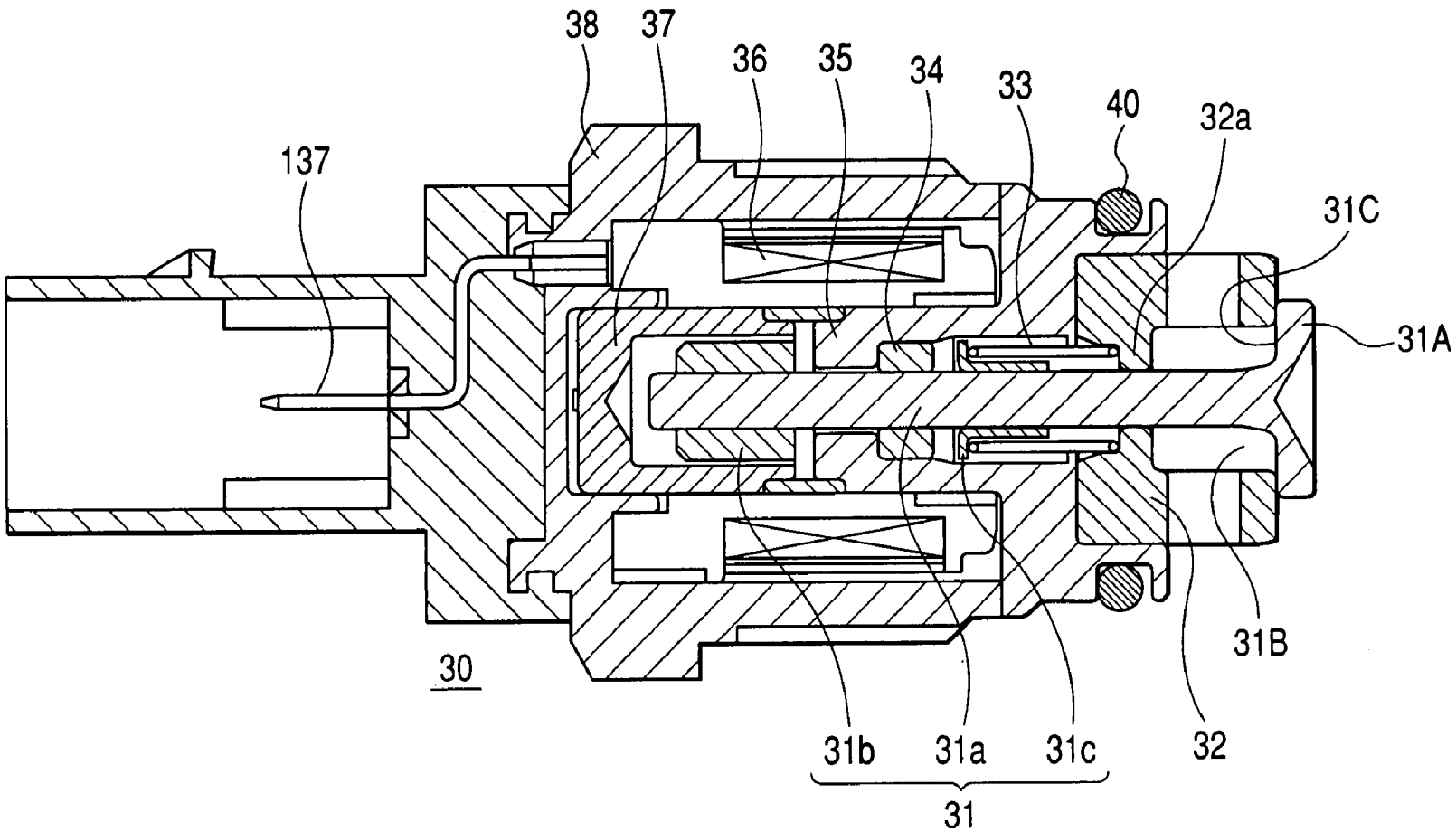
FIG. 6 is a longitudinal sectional view of an electromagnetic intake valve applied to a high-pressure fuel supply pump of a first embodiment according to the present invention.

FIG. 6 shows an electromagnetic intake valve, alone.

An intake valve 31 comprises an intake valve plunger 31*a*, anchor 31*b*, and a spring stopper 31*c*; and the anchor 31*b* and the spring stopper 31*c* are press-fit and held by an intake valve plunger 31*a*. A biasing force of an intake valve spring 33 is adjusted at the position of the spring stopper 31*c*, and when an input voltage applied to a coil 36 is turned off, the intake valve is closed due to a biasing force of the intake valve spring 33. When the valve is closed, the fuel sealing property is maintained by an intake valve plunger 31*a* coming in contact with a valve block 32. The clearance between a first holding member 34 and the intake valve 31*a* of the intake valve 31 is kept so that the intake valve 31 can slide.

When an intake valve is repeatedly opened and closed by repeatedly applying an input voltage to the coil 36 and turning it off, the intake valve 31 swings like a pendulum with a first holding member 34 as the center. This causes the opening and closing operations of the intake valve 31 to become unstable. Furthermore, if the intake valve 31 swings with large amplitude, the anchor 31*b* comes in contact with core 37, causing the opening and closing operations of the intake valve 31 to become more unstable. If the opening and closing operations of the intake valve 31 become unstable, it becomes impossible to stably control and supply the amount of high-pressure fuel.

Therefore, a second holding part 32*a* is provided in the valve block 32. The clearance between the intake valve plunger 31*a* and the second holding part 32*a* is provided to restrict pendulum motions that occur when the intake valve 31 repeatedly opens and closes, and does not block the sliding motions.

As a result, even if the intake valve 31 repeatedly opens and closes by repeatedly applying an input voltage to the coil 36 and turning it off, the intake valve 31 does not swing like a pendulum, and the anchor 31*b* does not come in contact with core (B) 37. Therefore, stable opening and closing operations can be ensured, thereby making it possible to stably control and supply the amount of high-pressure fuel.

Furthermore, since the intake valve spring 33 is incorporated in the intake valve 31, it is possible to integrate the intake valve 31 and the valve block 32 into a unit of electromagnetic intake valve. Furthermore, it is mounted to a pump body 1 by inserting a screw threaded on the outer circumference of the yoke 38 into a screw thread made on the pump body 1.

By doing so, it is possible to integrate the intake valve 31 into a unit; and since the integrated unit can be incorporated into the pump body, the number of fabrication steps can be reduced.

Embodiment 2

Next, a second embodiment of the present invention will be described with reference to FIGS. 7 and 8.

Figure 7:
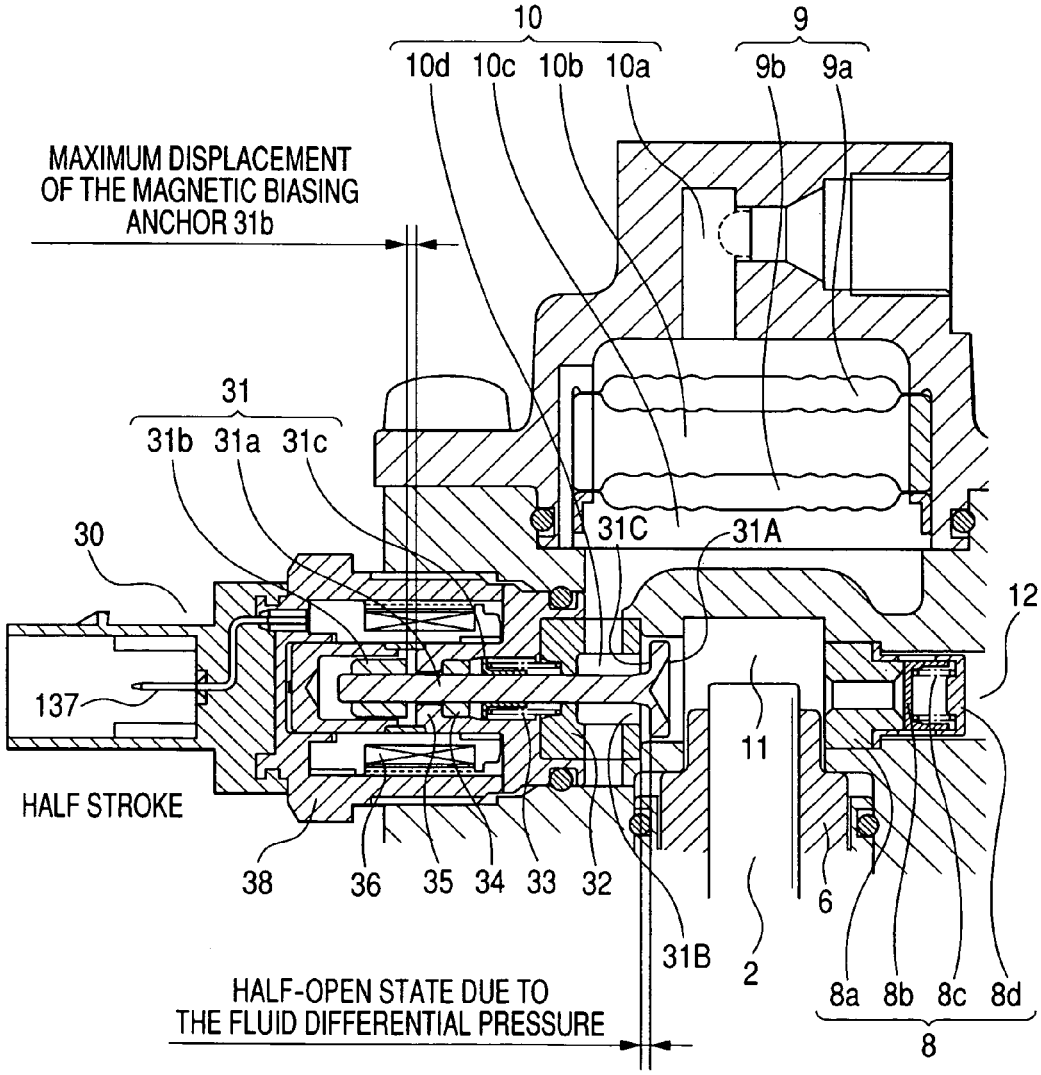
FIG. 7 is a partial longitudinal sectional view of a high-pressure fuel supply pump of a second embodiment according to the present invention.

FIG. 7 is an enlarged view of the inside of the pump. What is different from FIG. 3 and FIG. 4 is that the intake valve 31 is open but is not fully open, and does not come in contact with core 35 which is a restricting member.

Figure 8:
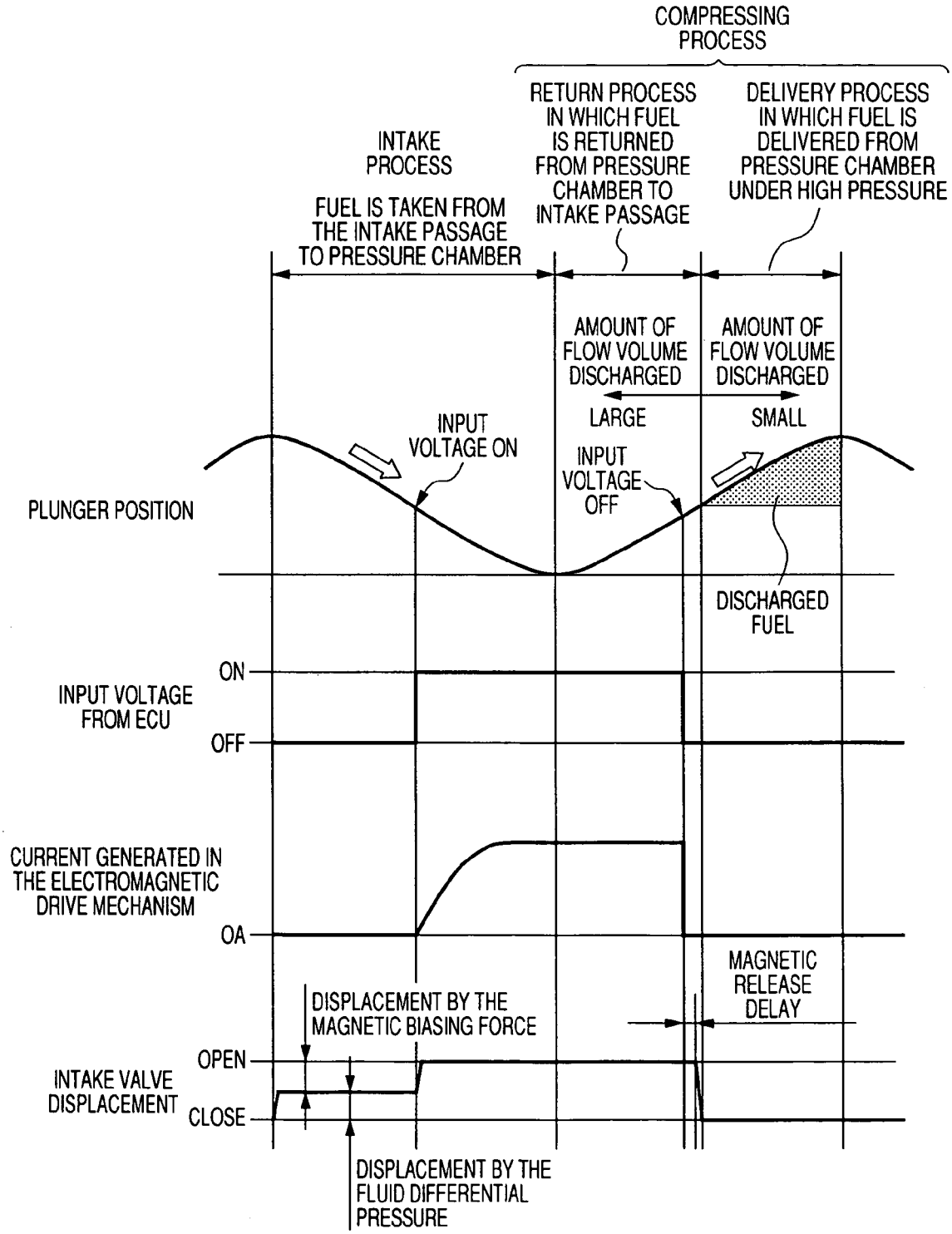
FIG. 8 is an operation diagram of a high-pressure fuel supply pump of a second embodiment according to the present invention.

FIG. 8 shows the operation of the pump. What is different from FIG. 5 is that the intake valve 31 is open but is not fully open until halfway of the intake process, and does not come in contact with core 35 which is a restricting member.

When the plunger 2 is functioning in the intake process as the result of the rotation of the cam 5, the volume of the pressure chamber 11 increases and the fuel pressure decreases. If the fuel pressure of the pressure chamber 11 becomes lower than the pressure of the intake passage 10*d*, a valve-opening force is generated by fluid differential pressure of fuel in the intake valve 31.

Due to the valve-opening force caused by the fluid differential pressure, the intake valve 31 overcomes the biasing force of the intake valve spring 33 thereby becoming open, as shown in FIG. 7; however, it has been determined that the value of the biasing force of the intake valve spring 33 be small so that the fluid differential pressure is balanced with the biasing force generated by the intake valve spring 33, and the intake valve 31 does not come in contact with core 35 which is a restricting member.

In this condition, if an input voltage from the ECU 27 is applied to a terminal 137, a current flows through the coil 36. This current generates a magnetic biasing force that attracts the anchor 31*b* and core 35 to each other, then the intake valve 31 moves the remaining strokes and collides with core 35 which is a restricting member.

Furthermore, because the intake valve 31 has displaced to the position at which a valve-opening force generated by the fluid differential pressure is balanced with a biasing force of the intake valve spring 33, collision noise that is caused by applying an input voltage is quieter than the collision noise made by moving full stroke.

The above configuration makes it possible to dampen the collision noise made when an electromagnetic intake valve 30 operates without using a damping alloy, and also makes it possible to control the amount of fuel delivered when the capacity is increased.

Embodiment 3

Next, a third embodiment of the present invention will be described with reference to FIG. 9.

Figure 9:
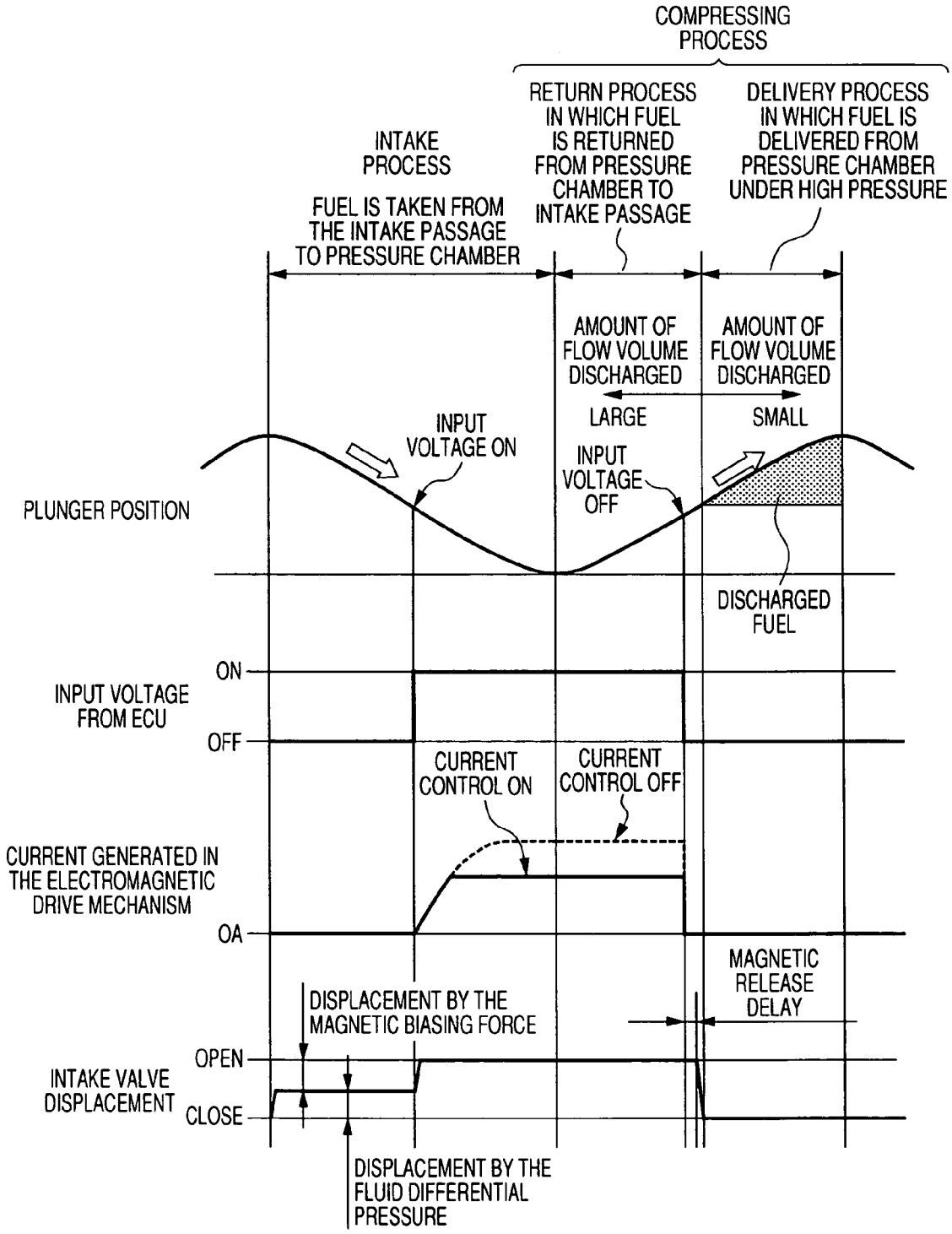
FIG. 9 is an operation diagram of a high-pressure fuel supply pump of a third embodiment according to the present invention.

FIG. 9 shows the operation of the pump. What is different from FIG. 8 is that generated current is restricted.

When the plunger 2 is functioning in the intake process as the result of the rotation of the cam 5, the volume of the pressure chamber 11 increases and the fuel pressure decreases. If the fuel pressure of the pressure chamber 11 becomes lower than the pressure of the intake passage 10*d*, a valve-opening force is generated by fluid differential pressure of fuel in the intake valve 31.

Due to the valve-opening force, the valve overcomes a biasing force of the intake valve spring 33 and opens. At this time, as shown in FIG. 5, it is possible to determine the necessary biasing force of the intake valve spring 33 so that the valve fully opens due to the fluid differential pressure, and comes in contact with core 35 which is a restricting member. Furthermore, it is also possible to determine the necessary biasing force of the intake valve spring 33 so that the fluid differential pressure is balanced with the biasing force of the intake valve spring 33 and the intake valve 31 does not come in contact with core 35 which is a restricting member as shown in FIG. 7.

In this condition, if an input voltage from the ECU 27 is applied to a terminal 137, a current flows through the coil 36. This current is controlled as shown by the solid line with a waveform in FIG. 9. The waveform shown by the broken line in FIG. 9 is a current waveform when current is not controlled. When the value of the current is small, the value of the magnetic biasing force that is applied to the intake valve 31 is also small.

This configuration makes it possible to make the collision noise made when the intake valve 31 collides with core (A) 35 quieter than that of embodiment 2.

Furthermore, during the compressing process of the plunger 2, both the biasing force of the intake valve spring 33 and the valve-closing force generated when fuel flows back from the pressure chamber 11 to the intake passage 10*d* are applied to the intake valve 31; and therefore, it is possible to control the amount of fuel delivered under high pressure by controlling current so that the magnetic biasing force greater than those resultant forces can be generated in the intake valve 31.

The above configuration makes it possible to further dampen the collision noise made when an electromagnetic intake valve 30 operates without using a damping alloy, and also makes it possible to control the amount of fuel delivered when the capacity is increased.

Furthermore, because the value of the current flowing through the coil 36 is small, the amount of generated heat is low, thereby keeping the power consumption low.

Moreover, because the amount of generated heat is small, the coil 36 will not be broken.

Embodiment 4

Next, a fourth embodiment of the present invention will be described with reference to FIG. 10.

Figure 10:
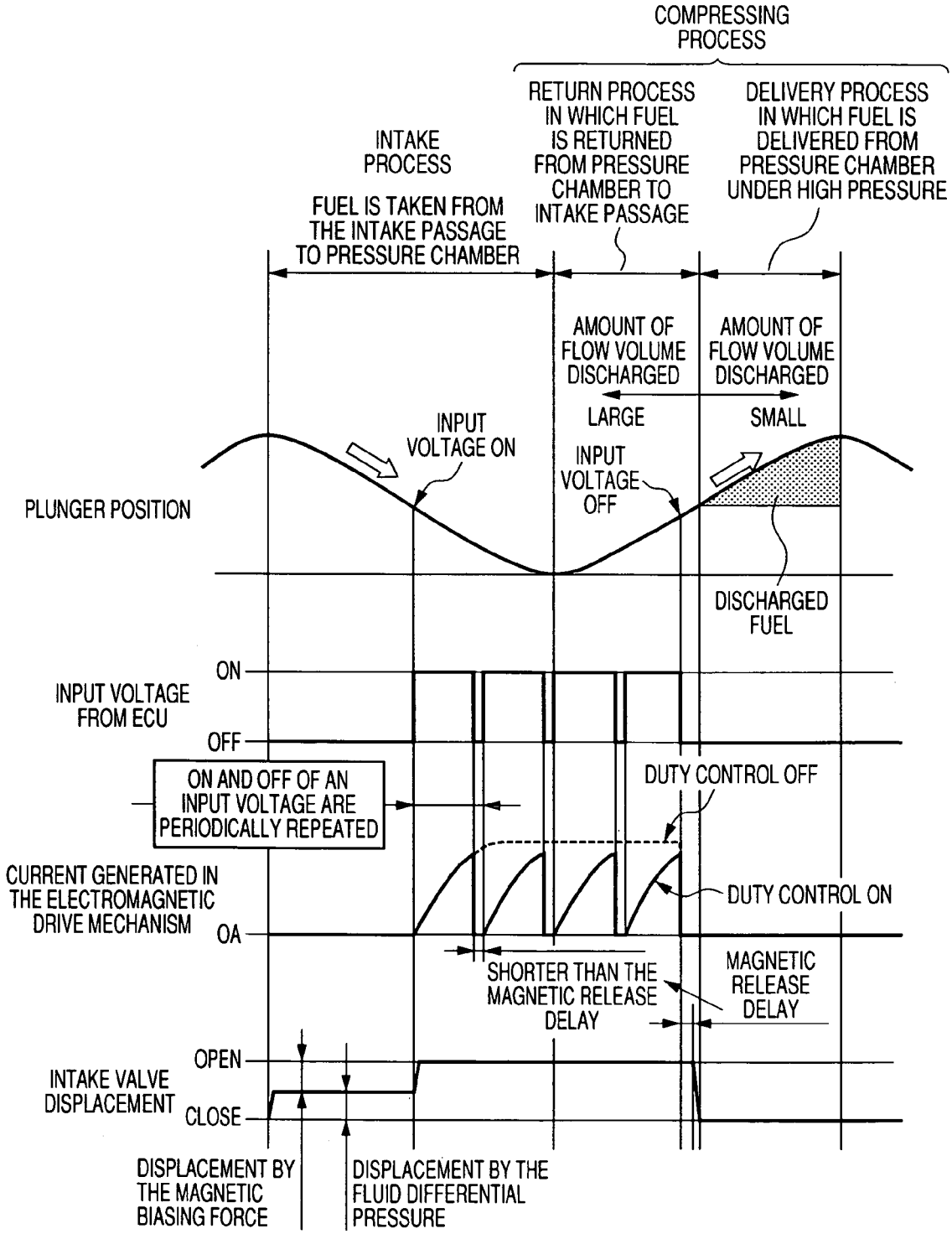
FIG. 10 is an operation diagram of a high-pressure fuel supply pump of a fourth embodiment according to the present invention.

FIG. 10 shows the operation of the pump. What is different from FIG. 8 is that during the period from when an input voltage is applied to when it is turned off, the input voltage is periodically applied and turned off in a shorter circle.

When the plunger 2 is functioning in the intake process as the result of the rotation of the cam 5, the volume of the pressure chamber 11 increases and the fuel pressure decreases. If the fuel pressure of the pressure chamber 11 becomes lower than the pressure of the intake passage 10*d*, a valve-opening force is generated by fluid differential pressure of fuel in the intake valve 31.

Due to the valve-opening force, the intake valve 31 overcomes a biasing force of the intake valve spring 33 and opens. At this time, as shown in FIG. 5, it is possible to determine the necessary biasing force of the intake valve spring 33 so that the intake valve 31 fully opens due to the fluid differential pressure, and comes in contact with core 35 which is a restricting member. Furthermore, it is also possible to determine the necessary biasing force of the intake valve spring 33 so that the fluid differential pressure is balanced with the biasing force of the intake valve spring 33 and the intake valve 31 does not come in contact with core 35 which is a restricting member as shown in FIG. 10.

In this condition, if an input voltage from the ECU 27 is applied to a terminal 137, a current flows through the coil 36. At this point in time, during the period from when an input voltage is applied to when it is turned off, the input voltage is periodically applied and turned off in a shorter circle. If, in this way, the time period from when an input voltage is applied to when it is turned off is controlled by means of the DUTY control, current flowing through the coil 36 is as shown by the solid line with a waveform in FIG. 10. The waveform, shown by the broken line in FIG. 10, is a waveform of the current when the DUTY control is not executed. Because the input voltage is periodically applied and turned off in a shorter circle during the period from when an input voltage is applied to when it is turned off, the current that started to flow decreases to zero, but the current starts to flow again by the application of the voltage. Even if the value of the current decreases to zero, the magnetic biasing force that has been generated in the intake valve 31 is not immediately eliminated. As shown in FIG. 10, there is a magnetic release delay, and the magnetic biasing force can be held even if current does not flow for a certain period. Therefore, even if the value of the current decreases to zero, if another cycle causes an input voltage to be applied so that current starts to flow again during the time of the magnetic release delay, the intake valve 31 can be kept open, or it is possible to ensure sufficient magnetic biasing force to keep the valve body open.

This configuration makes it possible to make the collision noise made when the anchor 31*b* collides with core 35 quieter than that of embodiment 2.

Furthermore, during the compressing process of the plunger 2, both the biasing force caused by the intake valve spring 33 and the valve-closing force due to a fluid force generated when fuel flows back from the pressure chamber 11 to the intake passage 10*d* are applied to the intake valve 31; and therefore, it is possible to control the amount of fuel delivered under high pressure by creating a short cycle and determining the appropriate timing for applying and turning off an input voltage so that a magnetic biasing force greater than those resultant forces can always be generated in the intake valve 31 during the period from when an input voltage is applied to when it is turned off.

The above configuration makes it possible to further dampen the collision noise made when an electromagnetic intake valve 30 operates without using a damping alloy, and also makes it possible to control the amount of fuel delivered when the capacity is increased.

Figure 11:
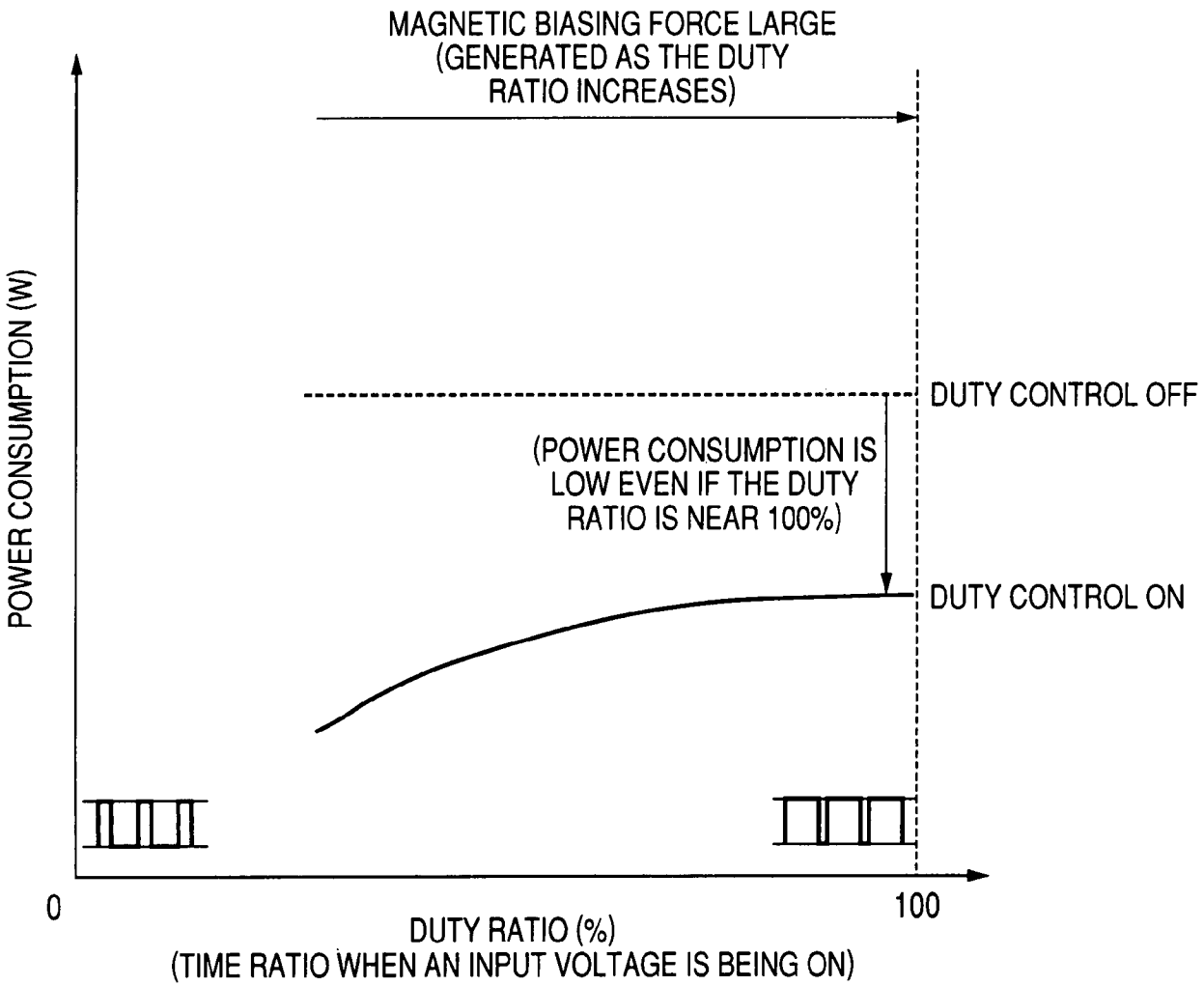
FIG. 11 is a drawing showing a relationship between the DUTY ratio (ratio of time while an input voltage is being ON) in the DUTY control is executed and power consumed by a coil of an electromagnetic intake valve in a fourth embodiment according to the present invention.

Furthermore, the waveform of the current flowing through the coil 36 is as shown in FIG. 10. If an input voltage is applied again after it has been once turned off, current starts to flow again, but due to the inductance of the coil 36, the current gradually starts flowing as shown by the solid line with a curve in FIG. 10. Consequently, the amount of heat generated in the coil 36 can be effectively reduced. FIG. 11 shows the relationship between the DUTY ratio (ratio of the time period when an input voltage is being ON) obtained as the result of the DUTY control of the time period from when an input voltage is applied to when it is turned off, as shown above by the solid line, and the power consumed by the coil 36. The broken line in FIG. 11 shows power consumption when the DUTY control is not executed. In order to generate a greater magnetic biasing force in the intake valve 31, it is necessary to make the DUTY ratio as large as possible. On the other hand, when compared to the occasion in which the DUTY control is not executed, power consumed by the coil 36 can be sufficiently reduced even when the DUTY ratio is near 100%. Therefore, it is possible to effectively keep power consumed by the electromagnetic intake valve 30 low.

Thus, because the amount of generated heat can be small, the coil 36 will not be broken.

Furthermore, it is also possible to simplify the ECU circuit when compared to embodiment 3 in which the current is controlled. This is an advantage.

Embodiment 5

Next, a fifth embodiment of the present invention will be described with reference to FIG. 12.

Figure 12:
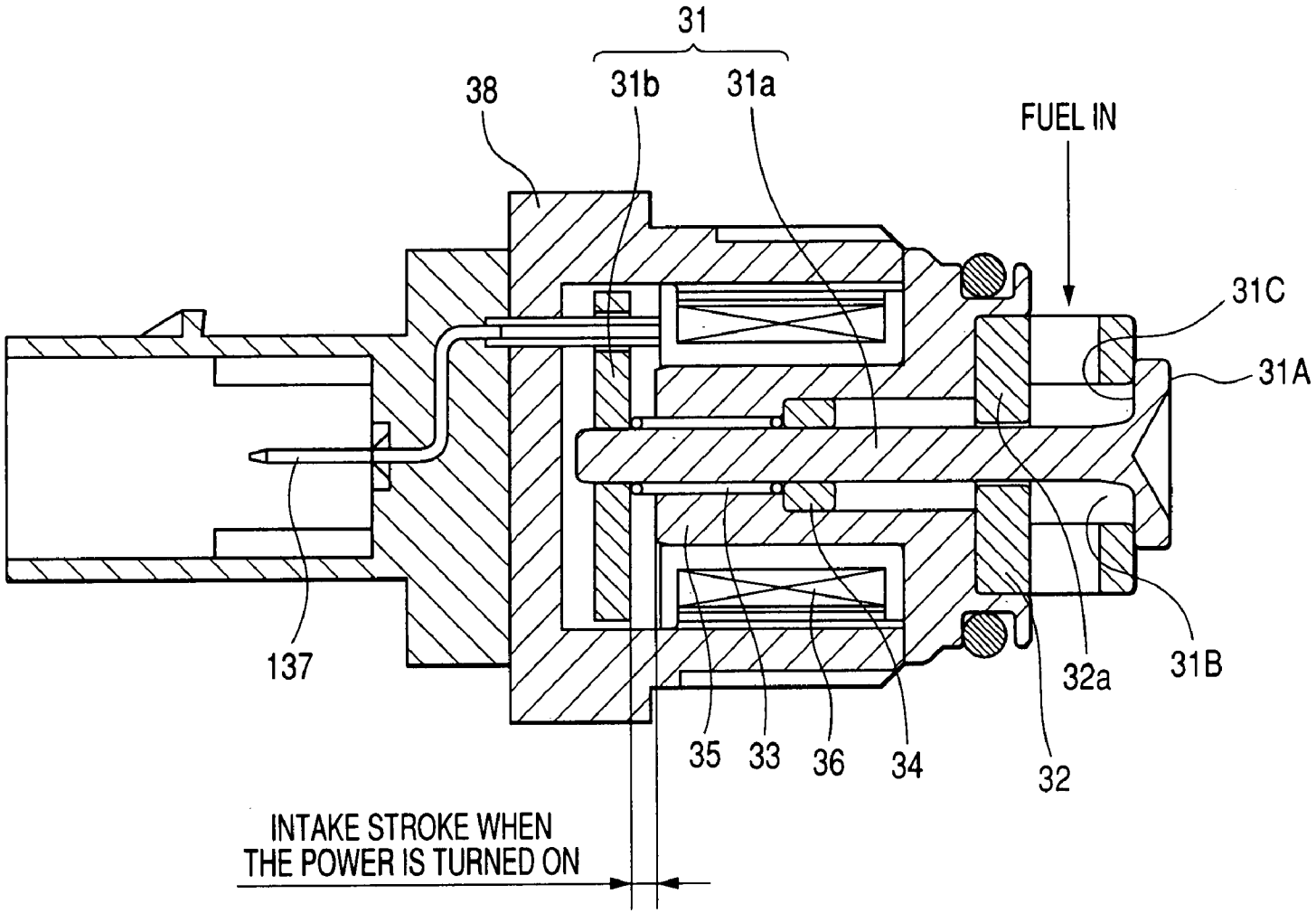
FIG. 12 is a longitudinal sectional view of an electromagnetic intake valve applied to a high-pressure fuel supply pump of a fifth embodiment according to the present invention.

FIG. 12 shows a single electromagnetic intake valve.

An intake valve 31 comprises an intake valve plunger 31*a* and an anchor 31*b*, and the anchor 31*b* is press-fit and held by the intake valve plunger 31*a*. A biasing force of an intake valve spring 33 is adjusted at the position of the anchor 31*b*, and when an input voltage is not applied to a coil 36, the intake valve is closed due to a biasing force of the intake valve spring 33. The clearance between a first holding member 34 and the intake valve plunger 31*a* of the intake valve 31 is kept so that the intake valve 31 can slide.

When an intake valve is repeatedly opened and closed by repeatedly applying an input voltage to the coil 36 and turning it off, the intake valve 31 swings like a pendulum with a first holding member 34 as the center. This causes the opening and closing operations of the intake valve 31 to become unstable. If the opening and closing operations of the intake valve 31 become unstable, it becomes impossible to stably control and supply the amount of high-pressure fuel.

Therefore, a second holding part 32*a* is provided in the valve block 32. The clearance between the intake valve plunger 31*a* and the second holding part 32*a* is provided to restrict pendulum motions that occur when the intake valve 31 repeatedly opens and closes, and does not block the sliding motions.

As a result, even if the intake valve 31 repeatedly opens and closes by repeatedly applying an input voltage to the coil 36 and turning it off, the intake valve 31 does not swing like a pendulum. Therefore, stable opening and closing operations can be ensured, thereby making it possible to stably control and supply the amount of high-pressure fuel.

Furthermore, since the intake valve spring 33 is incorporated in the intake valve 31, it is possible to integrate the intake valve 31 and the valve block 32 into a unit of electromagnetic intake valve. Furthermore, it is mounted to the pump body 1 by inserting a screw threaded on the outer circumference of the yoke 38 into a screw thread made on the pump body 1.

By doing so, it is possible to integrate the intake valve 31 into a unit, and since the integrated unit can be incorporated into the pump body, the number of fabrication steps can be reduced.

Thus, problems to be solved by this embodiment, description of the embodiment, and the effects of the embodiment can be summarized as follows:

This embodiment relates to an electromagnetic drive mechanism; specifically to a high-pressure fuel supply pump for pumping high-pressure fuel to a fuel injection valve of an internal combustion engine that uses this kind of electromagnetic drive mechanism. It also relates to a high-pressure fuel supply pump including a fuel discharge variable controlling mechanism which controls the amount of fuel delivered.

This embodiment can be applied to a high-pressure fuel supply pump including a fuel discharge variable controlling mechanism which controls the amount of fuel delivered which is described in International Publication WO00-47888.

There is a problem with the one described in International Publication WO00-47888 in that if the capacity of the high-pressure fuel supply pump is increased and the amount of high-pressure fuel to be delivered is increased, it is not possible to control the amount of flow volume to be delivered so that it becomes very low or zero by using the variable displacement control mechanism.

In other words, when trying to control the flow volume to become very low or zero by using a variable displacement control mechanism which opens an intake valve by means of a spring force when an input voltage to an electromagnetic drive mechanism is turned off, most of the fuel that has been taken into the pressure chamber via an intake passage as the volume of the pressure chamber increases during the intake process of the plunger has to be returned to the intake passage via the intake valve when the volume of the pressure chamber decreases during the compressing process of the plunger. At this time, a valve-closing force is applied to the intake valve which is caused by a fluid force generated when fuel flows back. Therefore, the spring force must be set to become greater than the valve-closing force. This is because if the valve-closing force is greater and the intake valve closes as the result of resisting the spring force, the high-pressure fuel discharge starts at that point in time, thereby making it impossible to control the flow volume so that it becomes very low or zero.

On the other hand, in order to increase the discharge capacity of the high-pressure fuel supply pump, it is necessary to increase the diameter of the plunger or to increase the stroke of the reciprocating movement of the plunger. At this point, because a lot of fuel is taken into the pressure chamber via the intake passage as the volume of the pressure chamber increases during the intake process of the plunger, the amount of fuel returned to the intake passage from the pressure chamber as the volume of the pressure chamber decreases during the compressing process of the plunger becomes large. Then, the valve-closing force generated when fuel flows back increases, which causes the intake valve to unexpectedly close as it resists the spring force, thereby making it impossible to control the flow volume to become very low or zero.

Furthermore, to solve the above problem, if the spring force is made greater than a relatively great valve-closing force, another problem arises in that the electromagnetic drive mechanism must generate a magnetic biasing force greater than the relatively great spring force in order to close the intake valve, which causes the electromagnetic drive mechanism to consume a large amount of electric power.

Or, there is another problem in that this large, power consumption results in generating a large amount of heat in the electromagnetic drive mechanism, which may result in a broken wire of the coil.

Furthermore, another problem arises in that if the fuel discharge variable controlling mechanism is activated to control the amount of fuel delivered under high pressure, a loud noise is generated when a restricting member which restricts the movement of the movable member collides with a movable part.

Or, if a damping alloy is provided in the colliding part so as to dampen the collision noise, as shown in Japanese Application Patent Laid-Open Publication No. 2002-250462, the production cost increases. Furthermore, there is another problem in decreased reliability.

Moreover, there is yet another problem in that when the electromagnetic drive mechanism is driven to repeatedly open and close the intake valve, the intake valve also moves in a direction perpendicular to the direction along which the intake valve slides, which makes opening and closing operations of the intake valve, especially the closing operation, unstable, and the amount of flow volume delivered is not constant.

Furthermore, still yet another problem is that an electromagnetic drive mechanism and an intake valve must separately be incorporated into the high-pressure fuel supply pump body, thereby causing the number of fabrication processes to increase.

This embodiment is able to solve at least one of those problems, it embodies a high-pressure fuel supply pump whose capacity can be increased and which controls the amount of fuel delivered under high pressure, thereby damping operating sounds made by the variable displacement control mechanism.

Specifically, an electromagnetic drive mechanism (electromagnetic intake valve 30), comprising a movable plunger (intake valve plunger 31*a*, anchor 31*b*) operated by an electromagnetic force, a restricting member (core 35) for restricting the displacement of the plunger in a specific position, and a biasing member (intake valve spring 33) for biasing the movable plunger to the opposite side of the restricting member, is configured such that a force other than the electromagnetic force can aid the movable plunger along the same direction in which the movable plunger moves as the result of the electromagnetic force, and the electromagnetic force is applied to the plunger after the movable plunger has been moved a specific displacement in the direction toward the restricting member by means of a force other than the electromagnetic force. Herein, the plunger can drive not only the intake valve but also an overflow valve which is an inward-opening valve that opens and closes an overflow port through which overflowing fuel from the pressure chamber flows.

Furthermore, an electromagnetic valve mechanism comprises an inward-opening valve body (intake valve 31A or overflow valve) provided at a fluid intake port (intake port 31B), a movable plunger (intake valve plunger 31*a*) mounted to the valve body, an electromagnetic drive mechanism (electromagnetic intake valve 30) which electromagnetically biases the movable plunger and opens the valve body, and a spring (intake valve spring 33) which biases the valve body (intake port 31B) and the movable plunger (intake valve plunger 31*a*) along the direction of closing the fluid intake port (intake port 31B) and operates the valve body in the direction of opening the valve in cooperation with the fluid differential pressure between the upstream side pressure and the downstream side pressure of the valve body (intake valve 31A).

Moreover, an electromagnetic valve mechanism, comprising an inward-opening valve body (intake valve 31A) provided at a fluid intake port (intake port 31B), a movable plunger (intake valve plunger 31*a*) mounted to the valve body, a spring (intake valve spring 33) which biases the valve body (intake valve 31A) and the movable plunger (intake valve plunger 31*a*) in the direction along which the fluid intake port is closed, and an electromagnetic drive mechanism (electromagnetic intake valve 30) which electromagnetically biases the movable plunger and opens the valve body, is configured such that after the valve body has initially opened as the result of resisting the force of the spring caused by the fluid differential pressure between the upstream side pressure and the downstream side pressure of the valve body, the electromagnetic drive mechanism (electromagnetic intake valve 30) biases the movable plunger (intake valve plunger 31*a*) in the direction along which the valve body is kept open or kept further open.

More specifically, an electromagnetic intake valve, comprising an intake valve operated by a magnetic biasing force, an electromagnetic drive mechanism which opens the intake valve and keeps it open by the magnetic biasing force, a restricting member for restricting the displacement due to the open-operation of the intake valve in a specific position, and a spring which biases the intake valve in the direction of closing the valve, is configured such that the electromagnetic drive mechanism closes the intake valve due to a spring force when an input voltage is not applied and there is no fluid differential pressure between the intake channel side pressure and the pressure chamber side pressure of the intake valve. Then, during the intake process of the plunger, the spring force is adjusted so that the fluid differential pressure between the intake channel side pressure and the pressure chamber side pressure is applied to the intake valve as a result of an increase in the volume of the pressure chamber, thereby opening the intake valve.

When the fluid differential pressure is applied, the intake valve overcomes the spring force due to a valve-opening force and opens. At this time, it is possible to set the spring force so that the intake valve is fully open due to the fluid differential pressure, and the intake valve comes in contact with the restricting member. Furthermore, it is also possible to set the spring force so that the fluid differential pressure balances with the spring force thereby preventing the intake valve from coming in contact with the restricting member.

The above configuration makes it possible to set the value of the spring force to be very small.

If the plunger's intake process starts while an input voltage to the electromagnetic drive mechanism is turned off, the intake valve is kept open due to a fluid differential pressure between the intake channel side pressure and the pressure chamber side pressure which is generated due to an increase in the volume of the pressure chamber, and then an input voltage will be applied to the electromagnetic drive mechanism.

The intake valve has been completely displaced before an input voltage is applied, and when the intake valve is coming in contact with the restricting member, an additional collision will not occur even if a magnetic biasing force is applied. When the valve opens due to the fluid differential pressure, the intake valve collides with the restricting member; however, the fluid differential pressure is very small compared to the magnetic biasing force.

The above configuration decreases the impact force generated between the intake valve and the restricting member thereby making it possible to dampen the collision noise.

Furthermore, when the fluid differential pressure balances with the spring force, and the intake valve does not reach the restricting member before an input voltage is applied, the intake valve will displace remaining strokes toward the restricting member by means of the magnetic biasing force applied to the intake valve.

When the plunger is in the intake process, the volume of the pressure chamber increases by the amount of space the descending plunger creates, and therefore, fuel flows into the pressure chamber from the intake passage.

Until the plunger begins the compressing process, an input voltage is applied to the electromagnetic drive mechanism, thereby keeping the valve open. At this time, because the volume of the pressure chamber decreases by the amount of space created by the movement of the plunger, the corresponding amount of fuel that has flown into the pressure chamber will be returned to the intake passage. This process is called the "return process". At this time, the magnetic biasing force generated in the intake valve by the electromagnetic drive mechanism must be greater than the sum of the valve-closing force due to the fluid force generated when fuel flows back and the spring force. However, it is possible to set the value of the spring force small, thereby making it possible to generate a sufficient magnetic biasing force.

If an input voltage to the electromagnetic drive mechanism is turned off in the middle of the compressing process of the plunger and a magnetic biasing force that has been applied to the intake valve is turned off, the intake valve closes due to the valve-closing force generated when fuel flows back and the spring force. At this point in time, fuel in the pressure chamber is pressurized by the compressing motion of the plunger, and when the pressure of the fuel in the pressure chamber becomes higher than the discharge pressure, fuel starts to be delivered under high pressure from the discharge valve. This process is called the "delivery process". That is, the compressing process of the plunger includes a return process and a delivery process.

The controller 27 controls the amount of fuel delivered under high pressure by controlling the timing for turning off the input voltage applied to the electromagnetic drive mechanism. If the controller 27 turns off the input voltage earlier, the ratio of the return process of the compressing process is small and the ratio of the delivery process is large. This means that an amount of fuel returned from the pressure chamber to the intake passage is small, and an amount of fuel delivered under high pressure becomes large. If the controller 27 turns off the input voltage later, the ratio of the return process of the compressing process is large and the ratio of the delivery process is small. This means that an amount of fuel returned from the pressure chamber to the intake passage is large, and an amount of fuel delivered under high pressure becomes small.

The above configuration makes it possible for the capacity of the high-pressure fuel supply pump to be increased as well as enabling the variable displacement control mechanism to execute the controls.

Furthermore, at this time, the controller 27 controls current flowing through the electromagnetic drive mechanism so that it is minimized. Then, the magnetic biasing force becomes small, thereby further damping noise made when the intake valve and the restricting member collide with each other due to the application of the magnetic biasing force.

Also, it is possible to reduce the amount of power consumed by the electromagnetic drive mechanism.

Furthermore, it is possible to prevent the coil from a broken wire due to heat.

Furthermore, during the period from when an input voltage is applied to when it is turned off, the controller 27 outputs control signals so that an input voltage is periodically applied and turned off in a shorter cycle. By doing so, the value of the magnetic biasing force also becomes small, thereby further damping noise made when the intake valve and the restricting member collide with each other due to the application of the magnetic biasing force.

Thus, it is possible to reduce the amount of power consumed by the electromagnetic drive mechanism.

Furthermore, it is possible to prevent the coil from a broken wire due to heat.

As stated above, in this embodiment, a controller itself, an electromagnetic drive mechanism itself, or a control method of an electromagnetic valve mechanism itself have characteristics.

Furthermore, a first holding part which slidably holds the-intake valve is provided, and also a second holding part is provided which restricts the motion generated in a direction perpendicular to the direction of sliding when the intake valve slides.

This configuration keeps the opening and closing operations of the intake valve stable even when the intake valve repeatedly opens and closes by driving the electromagnetic intake valve, thereby making it possible to obtain a constant amount of fuel discharge.

Furthermore, by providing a spring inside the electromagnetic drive mechanism, it is possible to integrate the electromagnetic drive mechanism with the intake valve as a unit.

By doing so, it is possible to integrate as a unit the electromagnetic drive mechanism and the intake valve into the pump body thereby reducing the number of fabrication steps.

Moreover, in the above embodiment, if the intake port is used as the overflow port, and the intake valve is used as the overflow valve, another embodiment in which the overflow valve is driven by an electromagnetic mechanism can be configured.

What is claimed is:

1. An electromagnetic drive mechanism comprising:

a movable plunger operated by an electromagnetic force, a restricting member for restricting the displacement of the plunger in a specific position, and a biasing member for biasing the movable plunger to the opposite side of the restricting member, wherein the biasing member is the sole biasing member for biasing the movable plunger along the direction of closing the fluid intake port, a force other than the electromagnetic force may be applied to aid the movable plunger for resisting the force of the biasing member along the same direction in which the movable plunger moves due to the electromagnetic force, and the electromagnetic force is applied to the plunger after the movable plunger has been displaced a specific distance in the direction toward the direction of opening the fluid intake port against the biasing member by the force other than the electromagnetic force, wherein the specific distance is a portion of the specific position at which the restricting member restricts the displacement of the movable plunger, and the application of the electromagnetic force displaces the movable plunger from the specific distance to the specific position at which the restricting member restricts the displacement of the movable plunger.

2. An electromagnetic valve mechanism comprising:

an inward-opening valve body provided at a fluid intake port, a movable plunger mounted to the valve body, an electromagnetic drive mechanism for biasing electromagnetically the movable plunger thereby opening the valve body, and a spring for biasing the valve body and the movable plunger along the direction of closing the fluid intake port, wherein the spring is the sole spring for biasing the valve body and the movable plunger along the direction of closing the fluid intake port, the valve body is operated in the direction of opening for resisting the force of the spring by the fluid differential pressure between upstream side pressure and downstream side pressure of the valve body to a specific distance, wherein the specific distance is a portion of an available range of plunger displacement, and the electromagnetic force is applied to the movable plunger after the movable plunger has been displaced the specific distance in the direction toward the direction of opening the valve body by the fluid differential pressure and displaces the movable plunger from the specific distance to a specific position which is greater than the specific distance.

3. An electromagnetic valve mechanism comprising:

an inward-opening valve body provided at a fluid intake port, a movable plunger mounted to the valve body, a spring for biasing the valve body and the movable plunger in the direction along the direction of closing the fluid intake port, and an electromagnetic drive mechanism biasing electromagnetically the movable plunger and opening the valve body, wherein the spring is the sole spring for biasing the valve body and the movable plunger in the direction alone the direction of closing fluid intake portion, and after the valve body has initially opened a specific distance as the result of resisting the force of the spring caused by the fluid differential pressure between upstream side pressure and downstream side pressure of the valve body, the electromagnetic drive mechanism applies an electromagnetic force to the movable plunger for biasing the movable plunger in the direction along which the valve body is kept open or kept further open and displaces the movable plunger from the specific distance to a specific position which is greater than the specific distance.

4. A high-pressure fuel supply pump including an intake valve operated by an electromagnetic drive mechanism according to claim 1.

5. A high-pressure fuel supply pump including an electromagnetic valve mechanism according to claim 2.

6. A high-pressure fuel supply pump including an intake channel through which fuel is taken into a pressure chamber, a discharge channel through which the fuel is delivered from the pressure chamber, and a plunger which reciprocates in the pressure chamber draws and discharges the fuel, and the intake channel has an electromagnetic intake valve and the discharge channel has a discharge valve, and the amount of fuel delivered is controlled by connecting and disconnecting the intake channel to the pressure chamber by opening and closing the electromagnetic intake valve; wherein the electromagnetic intake valve is an electromagnetic drive mechanism comprising an intake valve operated by a magnetic biasing force, the electromagnetic drive mechanism opens the intake valve and keeps it open by means of the magnetic biasing force, a restricting member for restricting, in a specific position, the displacement of the intake valve when it opens, and a biasing member for biasing the intake valve in the direction of closing the valve, wherein the biasing member is the sole biasing member for biasing the intake valve in the direction of closing the valve, and when the electromagnetic drive mechanism is turned off, after the intake valve is displaced in the direction of opening the valve for resisting the force of the biasing member a specific distance which is a portion of the specific position due to a fluid differential pressure between the intake channel side pressure and pressure chamber side pressure of the intake valve, the electromagnetic drive mechanism is turned on and biases the movable plunger toward the direction of opening the intake valve body and displaces the movable plunger from the specific distance to a specific position which is greater than the specific distance.

7. A high-pressure fuel supply pump according to claim 6, wherein when the electromagnetic mechanism is turned off and there is no fluid differential pressure, the biasing member causes the intake valve to close.

8. A high-pressure fuel supply pump according to claim 7, wherein during intake process of the plunger, the intake valve is opened and kept open by applying an input voltage to the electromagnetic drive mechanism.

9. A high-pressure fuel supply pump according to claims 6, wherein after the intake valve has opened as the result of resisting a biasing force caused by the biasing member due to a fluid differential pressure between intake channel side pressure and pressure chamber side pressure of the intake valve, the intake valve is kept open or kept further open by applying an input voltage to the electromagnetic drive mechanism.

10. A high-pressure fuel supply pump according to claim 8, wherein after the valve is kept open while an input voltage is being ON to the electromagnetic drive mechanism, an input voltage is turned off during compressing process of the plunger, thereby shutting off current flowing through the electromagnetic drive mechanism.

11. A high-pressure fuel supply pump according to claim 10, wherein the flow volume of fuel delivered under high pressure is controlled by controlling the timing at which an input voltage applied to the electromagnetic drive mechanism is turned off according to the motion of the plunger.

12. A high-pressure fuel supply pump according to claim 6, wherein a spring is used as the biasing member.

13. A high-pressure fuel supply pump according to claim 6, wherein the value of current generated in the electromagnetic drive mechanism is controlled by changing the input voltage.

14. A high-pressure fuel supply pump including an intake channel through which fuel is taken into a pressure chamber, a discharge channel through which the fuel is delivered from the pressure chamber, and a plunger which reciprocates in the pressure chamber draws and discharges the fuel, and the intake channel has an electromagnetic intake valve and the discharge channel has a discharge valve, and the amount of fuel delivered is controlled by connecting and disconnecting the intake channel to the pressure chamber by opening and closing the electromagnetic intake valve, wherein the electromagnetic intake valve is an electromagnetic drive mechanism comprising an intake valve operated by a magnetic biasing force, the electromagnetic drive mechanism opens the intake valve and keeps it open by means of the magnetic biasing force, a restricting member for restricting, in a specific position, the displacement of the intake valve when it opens, and a biasing member for biasing the intake valve in the direction of closing the valve, wherein when the electromagnetic drive mechanism is turned off, after the intake valve is displaced in the direction of opening the valve for resisting the force of the biasing member due to a fluid differential pressure between the intake channel side pressure and pressure chamber side pressure of the intake valve, the electromagnetic drive mechanism is turned on and biases the movable plunger toward the direction of opening the intake valve body, and during the period from when an input voltage is applied to the electromagnetic drive mechanism to when it is turned off, the input voltage is periodically applied and turned off in a shorter cycle.

15. A high-pressure fuel supply pump according to claim 6, wherein a first holding part is provided for holding the intake valve slidably, and a second holding part is provided for restricting the motion generated in a direction perpendicular to the direction of sliding the plunger when the intake valve slides.

16. A high-pressure fuel supply pump according to claim 6, wherein the biasing member is located inside the electromagnetic drive mechanism.

17. A high-pressure fuel supply pump according to claim 16, wherein the electromagnetic intake valve is assembled as a unit.

* * * * *